US009482247B2

(12) United States Patent
Shelcoviz et al.

(10) Patent No.: US 9,482,247 B2
(45) Date of Patent: Nov. 1, 2016

(54) APPARATUS AND METHODS FOR DETERMINING A POSITION OF A PISTON IN A CAVITY

(71) Applicant: Curtiss-Wright Flow Control Corporation, Falls Church, VA (US)

(72) Inventors: Abraham Shelcoviz, Irvine, CA (US); Tsolag Apelian, Pomona, CA (US)

(73) Assignee: CURTISS-WRIGHT FLOW CONTROL CORPORATION, Falls Church, VA (US)

( * ) Notice: Subject to any disclaimer, the term of this patent is extended or adjusted under 35 U.S.C. 154(b) by 409 days.

(21) Appl. No.: 14/106,250

(22) Filed: Dec. 13, 2013

(65) Prior Publication Data

US 2015/0167700 A1 Jun. 18, 2015

(51) Int. Cl.
*F15B 15/28* (2006.01)

(52) U.S. Cl.
CPC .... *F15B 15/2838* (2013.01); *F15B 2211/6313* (2013.01); *F15B 2211/89* (2013.01)

(58) Field of Classification Search
CPC ..... F15B 15/2846; F15B 15/2838; F15B 2211/89; F16K 37/0066
See application file for complete search history.

(56) References Cited

U.S. PATENT DOCUMENTS

| | | | | |
|---|---|---|---|---|
| 2,826,165 | A | 3/1958 | Adelson | |
| 2,980,139 | A | 4/1961 | Lynn | |
| 3,207,468 | A | 9/1965 | Lauducci et al. | |
| 3,334,647 | A | 8/1967 | Whitelaw | |
| 3,486,416 | A | 12/1969 | Eastman | |
| 3,828,806 | A | 8/1974 | Glos | |
| 6,822,577 | B2 | 11/2004 | Tofino et al. | |
| 2002/0092863 | A1 | 7/2002 | Tofino et al. | |
| 2003/0084719 | A1 * | 5/2003 | Wiklund | F15B 15/2838 73/239 |
| 2008/0210505 | A1 * | 9/2008 | Vigholm | E02F 9/2207 188/266.2 |
| 2012/0074768 | A1 * | 3/2012 | Naito | B60T 1/10 303/3 |

FOREIGN PATENT DOCUMENTS

| | | |
|---|---|---|
| DE | 1115090 | 10/1961 |

* cited by examiner

*Primary Examiner* — Thomas E Lazo
*Assistant Examiner* — Abiy Teka
(74) *Attorney, Agent, or Firm* — Pearne & Gordon LLP

(57) ABSTRACT

A piston of an apparatus is movable within a cavity between a first position wherein a pressure port is in fluid communication with the first fluid chamber and a second position wherein the pressure port is in fluid communication with the second fluid chamber. In further examples, apparatus comprise an expansion chamber that is isolated from the first fluid chamber in a first condition and the expansion chamber is in fluid communication with the first fluid chamber in a second condition. In further examples, methods of operating an apparatus include the step (I) of applying fluid pressure to at least one of the first fluid chamber and the second fluid chamber, and the step (II) of determining a position of the piston within the cavity based on the applied fluid pressure.

15 Claims, 4 Drawing Sheets

APPARATUS AND METHODS FOR DETERMINING A POSITION OF A PISTON IN A CAVITY

TECHNICAL FIELD

The present invention relates generally to apparatus including a piston that is movable within a cavity and, more particularly, to apparatus and methods for determining a position of a piston in a cavity.

BACKGROUND

Various apparatus are known to include pistons that are movable within a cavity. For instance, the piston may divide the cavity into a first fluid chamber and a second fluid chamber. There is a desire to determine a position of the piston within the cavity.

SUMMARY

The following presents a simplified summary of the disclosure in order to provide a basic understanding of some example aspects described in the detailed description.

In a first aspect of the disclosure, an apparatus comprises a body comprising a cavity and a pressure port in fluid communication with the cavity. A piston divides the cavity into a first fluid chamber and a second fluid chamber. The piston is movable within the cavity between a first position wherein the pressure port is in fluid communication with the first fluid chamber and a second position wherein the pressure port is in fluid communication with the second fluid chamber.

In one example of the first aspect, the apparatus further comprises a pressure measuring device configured to measure a fluid pressure of the pressure port.

In another example of the first aspect, the apparatus further comprises a pressure source configured to pressurize at least one of the first fluid chamber and the second fluid chamber.

The first aspect may be provided alone or in combination with one or any combination of the examples of the first aspect discussed above.

In a second aspect of the disclosure, an apparatus comprises a body comprising a cavity and a piston dividing the cavity into a first fluid chamber and a second fluid chamber. The apparatus further includes an expansion chamber, wherein the apparatus is configured to be selectively placed in a first condition and a second condition. The first condition isolates the first fluid chamber from the expansion chamber such that a pressure of the first fluid chamber is not equalized with a pressure of the expansion chamber. The second condition provides the first fluid chamber in fluid communication with the expansion chamber such that the first fluid chamber and the expansion chamber are provided with an equalized pressure. The apparatus also includes a pressure measuring device configured to monitor the pressure of the first fluid chamber when the apparatus is placed in the first condition, and wherein the pressure measuring device is configured to monitor the equalized pressure of the first fluid chamber and the expansion chamber when the apparatus is placed in the second condition.

In one example of the second aspect, the apparatus further comprises a pressure source configured to provide the pressure of the first fluid chamber in the first condition. In one example, a valve is configured to provide selective fluid communication between the first fluid chamber and the pressure source.

In another example of the second aspect, the apparatus further comprises a valve configured to provide selective fluid communication between the first fluid chamber and the expansion chamber.

In still another example of the second aspect, the apparatus further comprises a vacuum source configured to selectively apply a vacuum to the expansion chamber.

The second aspect may be provided alone or in combination with one or any combination of the examples of the second aspect discussed above.

In a third aspect of the disclosure, a method of operating an apparatus is provided wherein the apparatus includes a body with a cavity and a piston dividing the cavity into a first fluid chamber and a second fluid chamber, wherein the piston is movable within the cavity. The method comprises the step (I) of applying fluid pressure to at least one of the first fluid chamber and the second fluid chamber. The method also includes the step (II) of determining a position of the piston within the cavity based on the applied fluid pressure.

In one example of the third aspect, the piston is movable within the cavity between a first position and a second position and the apparatus further includes a pressure port configured to be placed in fluid communication with the first fluid chamber in the first position and the second fluid chamber in the second position. Furthermore, step (II) includes monitoring a pressure of the pressure port to determine the position of the piston within the cavity.

In another example of the third aspect, step (I) includes pressurizing the first fluid chamber with the applied fluid pressure to bias the piston towards the first position and step (II) includes comparing the monitored pressure with the applied pressure to determine whether the piston is located in the first position.

In yet another example of the third aspect, step (I) includes pressurizing the second fluid chamber with the applied fluid pressure to bias the piston towards the second position and step (II) includes comparing the monitored pressure with the applied pressure to determine whether the piston is located in the second position.

In still another example of the third aspect, step (I) does not result in movement of the piston in the cavity.

In yet another example of the third aspect, step (I) pressurizes at least one of the first fluid chamber and the second fluid chamber and step (II) includes measuring a volume of a fluid chamber pressurized during step (I).

In another example of the third aspect, the step of measuring a volume of the pressurized fluid chamber includes calculating a volume of the pressurized fluid chamber.

In still another example of the third aspect, the calculated volume of the pressurized fluid chamber is used to determine the position of the piston in the cavity.

In yet another example of the third aspect, the step of calculating comprises continuously calculating the volume of the pressurized fluid chamber to continuously determine the position of the piston in the cavity.

In a further example of the third aspect, step (II) of calculating the volume of the pressurized fluid chamber includes the steps of: measuring an initial pressure of the pressurized fluid chamber; evacuating an expansion chamber of the apparatus, wherein the expansion chamber has an initial volume; then placing the expansion chamber in fluid communication with the pressurized fluid chamber such that gas expands from the pressurized fluid chamber to the expansion chamber to at least partially depressurize the pressurized fluid chamber, wherein an equalized pressure is obtained in the depressurized fluid chamber and the expansion chamber while the expansion chamber includes a final volume; then measuring the equalized pressure; and then calculating the volume of the depressurized fluid chamber based on the initial pressure, the final volume, and the equalized pressure.

In another example of the third aspect, the determined volume of the chamber together with a known volume of the cavity is used to determine the position of the piston in the cavity.

In still another example of the third aspect, step (I) does not result in movement of the piston in the cavity.

In yet another example of the third aspect, the expansion chamber has a fixed volume such that the initial volume is equal to the final volume.

The third aspect may be provided alone or in combination with one or any combination of the examples of the third aspect discussed above.

BRIEF DESCRIPTION OF THE DRAWINGS

These and other aspects are better understood when the following detailed description is read with reference to the accompanying drawings, in which.

DETAILED DESCRIPTION

Figure 1:
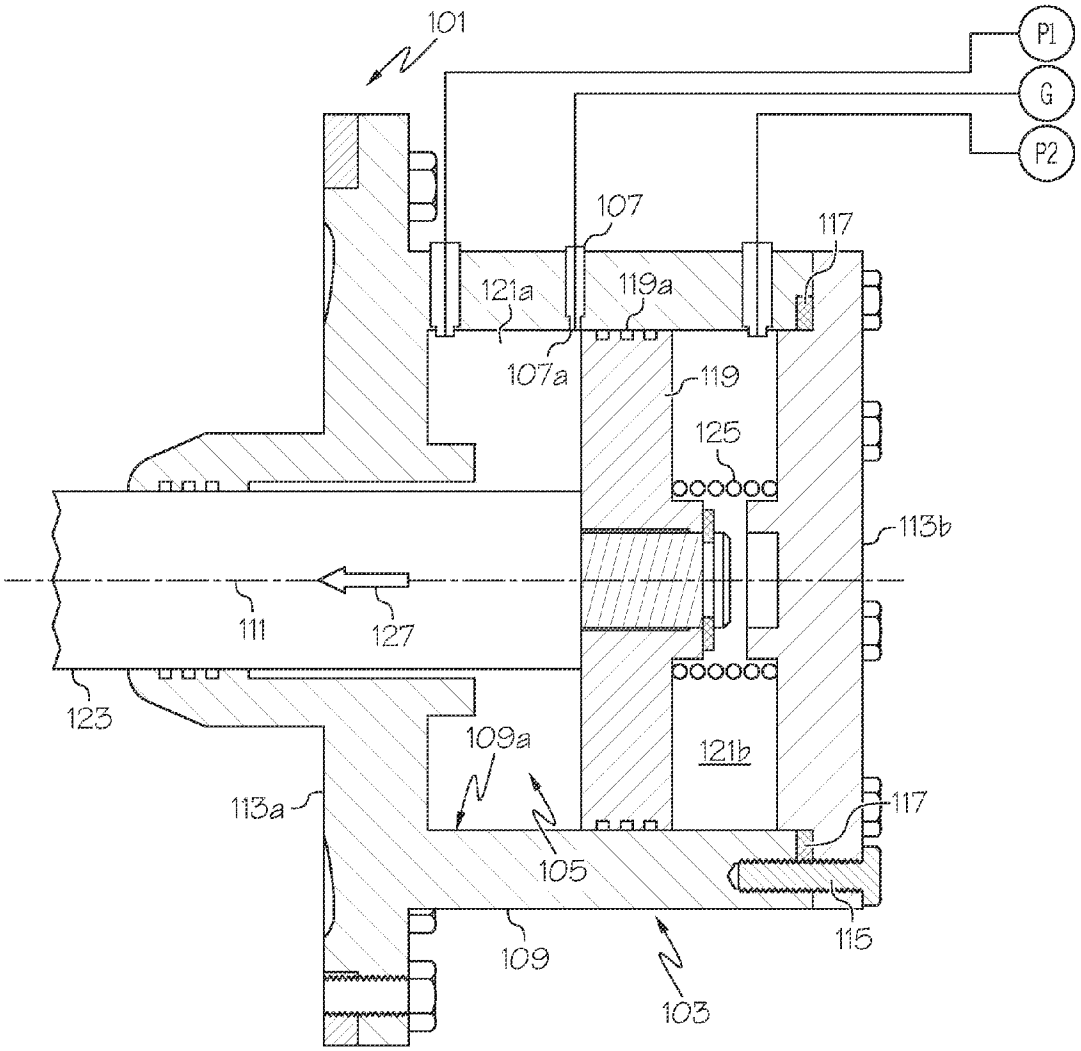
FIG. 1 is a cross-sectional view of a first example apparatus with the piston in a first position.

Examples will now be described more fully hereinafter with reference to the accompanying drawings in which example embodiments are shown. Whenever possible, the same reference numerals are used throughout the drawings to refer to the same or like parts. However, aspects may be embodied in many different forms and should not be construed as limited to the embodiments set forth herein.

The disclosure relates to apparatus with pistons that are movable within a cavity. The apparatus of the present disclosure are useful in a wide variety of applications wherein a piston is movable within a cavity. In just one illustrative example, a piston movable within a cavity may be incorporated as part of an actuator wherein fluid pressure may be applied to the piston to result in a desired translation of a force transmission rod. Aspects of the disclosure permit determining the position of a piston within a cavity. Although useful in all environments, aspects of the disclosure may determine the position of the piston within a cavity from a remote location.

FIG. 1 is a cross-sectional view of a first example apparatus 101 with a body 103 comprising a cavity 105 and a pressure port 107 in fluid communication with the cavity 105. In some examples, the body 103 may comprise a peripheral wall 109 circumscribing a central axis 111 of the apparatus 101. The body 103 can also include end walls 113*a*, 113*b* that function together with the peripheral wall 109 to seal the cavity 105. In one example, to simplify manufacture, one end wall 113*a* may be integral with the peripheral wall while the other end wall 113*b* may be removably connected with the peripheral wall 109 to simplify manufacture and maintenance of the apparatus 101. In one example, mechanical fasteners 115 may be threaded through a peripheral portion of the end wall 113*b* and into an outer edge of the peripheral wall 109 of the body 103. A seal 117 may operate to provide a fluid seal at the interface between the end wall 113*b* and the body 103.

The apparatus 101 further comprises a piston 119 dividing the cavity 105 into a first fluid chamber 121*a* and a second fluid chamber 121*b*. In one example, the piston includes an outer periphery 119*a* that is designed to provide a fluid seal with an inner surface 109*a* of the peripheral wall 109. As such, the piston 119 may provide a fluid barrier that prevents fluid communication between the first fluid chamber 121*a* and the second fluid chamber 121*b*. Although not shown, in another example, the piston may be suspended within the cavity by a flexible diaphragm attached to the inner surface 109*a* of the peripheral wall 109. The diaphragm allows the piston to move within the cavity without engaging the inner surface 109*a* of the peripheral wall 109. In some examples, the piston 119 may be coupled to a force transmission rod 123 and an optional compression spring 125 may be provided to bias the piston 119 in a direction 127 from a first position (shown in FIG. 1) towards a second position (shown in FIG. 2).

Figure 2:
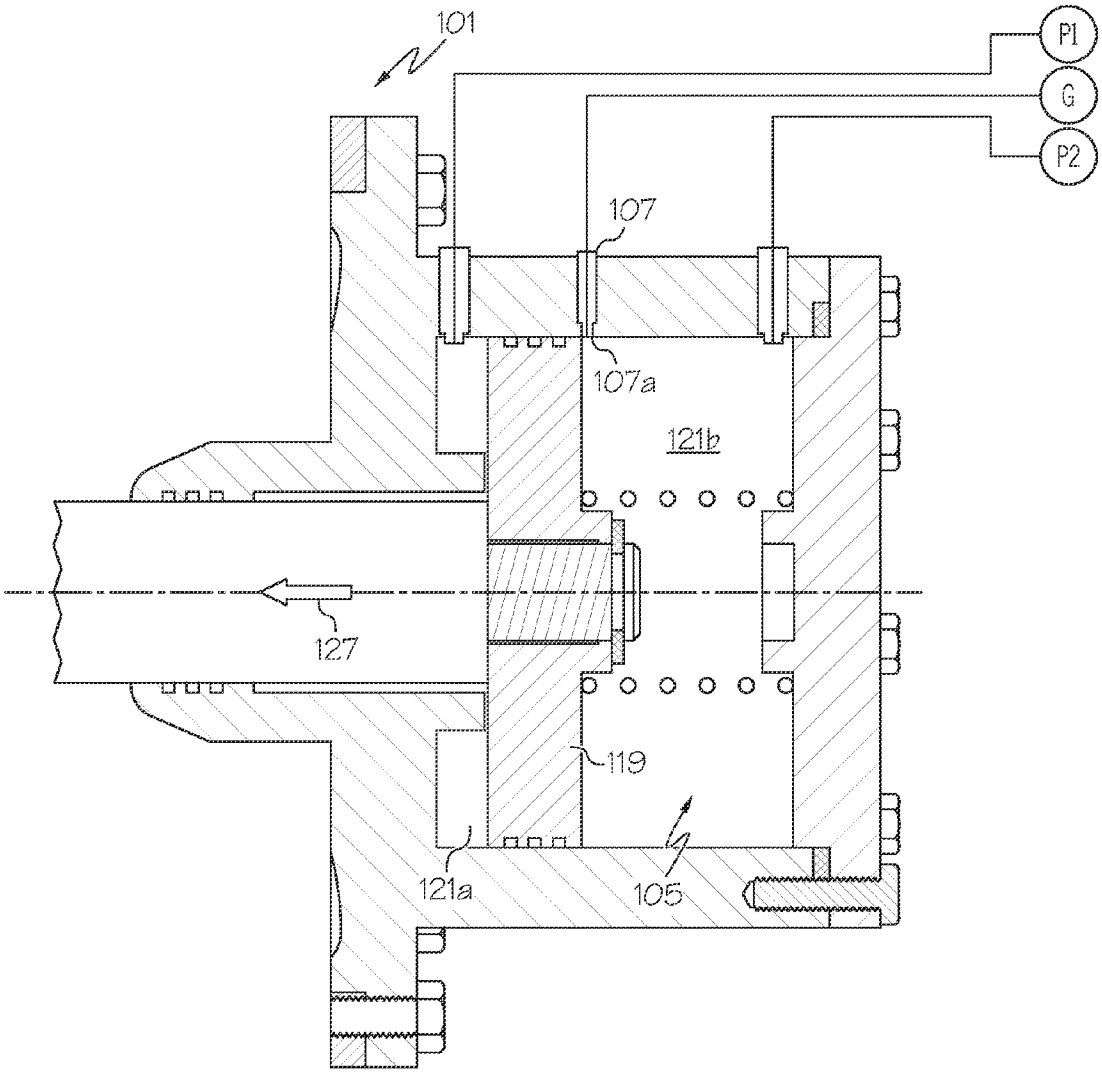
FIG. 2 is a cross-sectional view of the first example apparatus of FIG. 1 with the piston in a second position.

The piston 119 is movable within the cavity 105 between the first position (shown in FIG. 1) and the second position (shown in FIG. 2). As shown in FIG. 1, when the piston 119 is located in the first position, the pressure port 107 is in fluid communication with the first fluid chamber 121*a*. As shown in FIG. 2, when the piston 119 is located in the second position, the pressure port 107 is in fluid communication with the second fluid chamber 121*b*. Although not shown, at an intermediate position between the first position and the second position, the outer periphery 119*a* may seal around an entrance 107*a* of the pressure port 107 such that the pressure port 107 is not in fluid communication with either the first fluid chamber 121*a* or the second fluid chamber 121*b*.

As further illustrated in FIGS. 1 and 2, the apparatus 101 further includes a pressure measuring device, such as a pressure gauge "G", configured to measure a fluid pressure of the pressure port 107 at the entrance 107*a* of the pressure port 107. The apparatus 101 can further be provided with a pressure source configured to pressurize at least one of the first fluid chamber and the second fluid chamber. For example, as shown in FIGS. 1 and 2, the apparatus includes a first pressure source "P1" configured to pressurize the first fluid chamber 121*a* and a second pressure source "P2" configured to pressurize the second fluid chamber 121*b*. Although not shown, the apparatus may optionally include a single pressure source that may be designed to pressurize only one of the fluid chambers or a single pressure source designed to selectively pressurize one or both of the fluid chambers. The pressure source(s) may comprise a fluid pump, pressurized fluid vessel or other pressure source.

Figure 3:
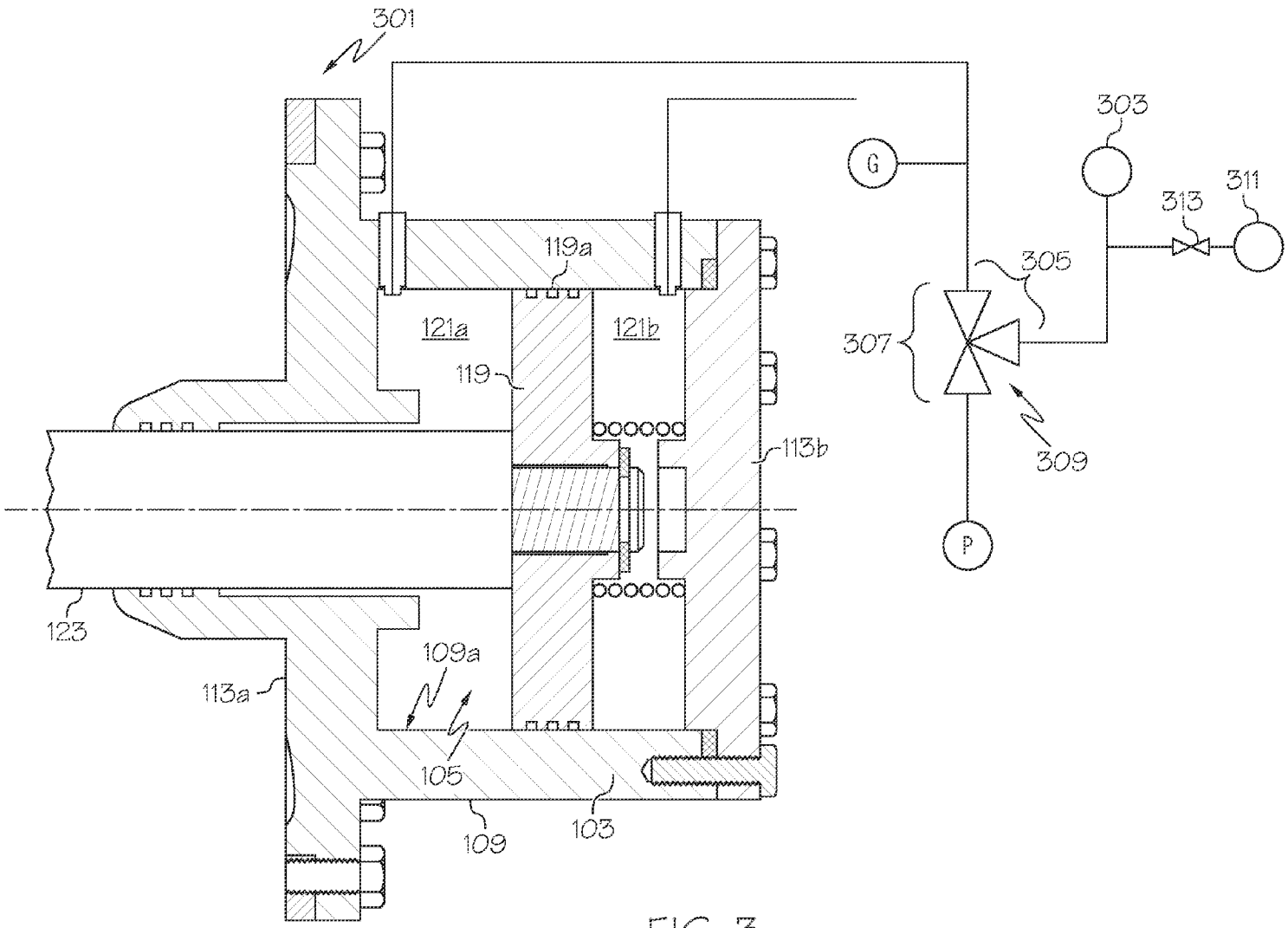
FIG. 3 is a cross-sectional view of a second example apparatus.
Figure 4:
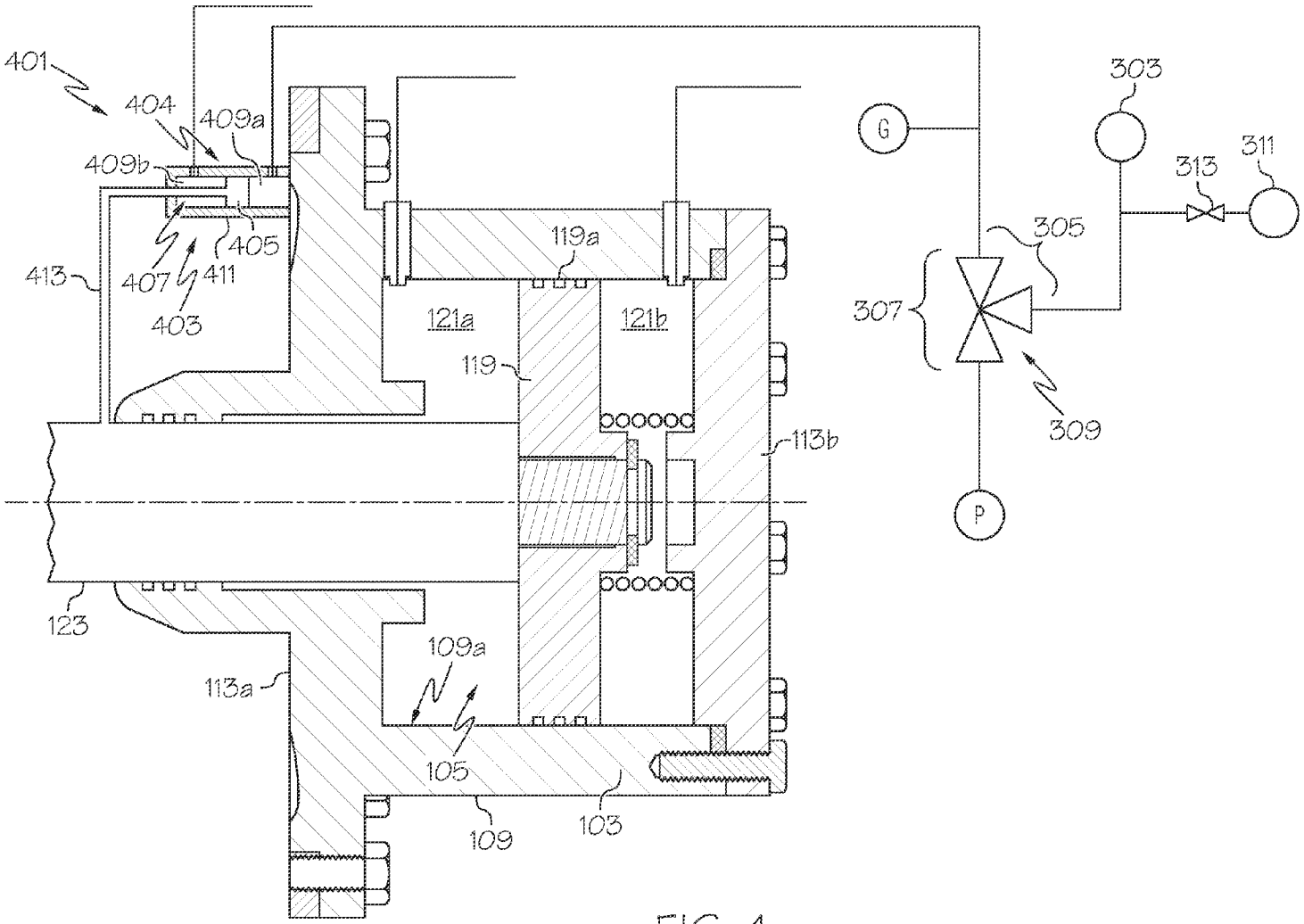
FIG. 4 is a cross-sectional view of a third example apparatus.

FIGS. 3 and 4 are cross-sectional views of a second example apparatus 301 and a third example apparatus 401, respectively. Unless otherwise indicated, certain features of the second and third example apparatus can be similar or identical to the features of the first example apparatus 101. Indeed, the second and third example apparatus 301, 401 includes the body 103 comprising the cavity 105 and the piston 119 dividing the cavity into the first fluid chamber 121*a* and the second fluid chamber 121*b*. Each apparatus 301, 401 further includes an expansion chamber 303. In some examples, the expansion chamber 303 may include a chamber with variable volume although the illustrated expansion chamber 303 is provided as a substantially rigid vessel with a fixed volume.

As shown in FIG. 3, the apparatus 301 is configured to be selectively placed in a first condition and a second condition. The first condition isolates the first fluid chamber 121*a* from the expansion chamber 303 such that a pressure of the first fluid chamber 121*a* is not equalized with a pressure of the expansion chamber 303. The second condition provides the first fluid chamber 121*a* in fluid communication with the expansion chamber 303 such that the first fluid chamber 121*a* and the expansion chamber 303 are provided with an equalized pressure.

As shown in FIG. 4, the apparatus 401 also includes an additional apparatus 403 including a piston 405 dividing a cavity 407 of a body 404 into a first fluid chamber 409*a* and a second fluid chamber 409*b*. The piston 405 includes an outer periphery that is designed to provide a fluid seal with an inner surface of a peripheral wall 411. As such, the piston 405 may provide a fluid barrier that prevents fluid communication between the first fluid chamber 409*a* and the second fluid chamber 409*b*. In some examples, the piston 405 may be coupled to a link 413 that couples the piston 405 to the force transmission rod 123.

As shown in FIG. 4, the apparatus 401 is configured to be selectively placed in a first condition and a second condition. The first condition isolates the first fluid chamber 409*a* from the expansion chamber 303 such that a pressure of the first fluid chamber 409*a* is not equalized with a pressure of the expansion chamber 303. The second condition provides the first fluid chamber 409*a* in fluid communication with the expansion chamber 303 such that the first fluid chamber 409*a* and the expansion chamber 303 are provided with an equalized pressure.

As shown in FIG. 3, a valve 305 may be provided that is configured to provide selective fluid communication between the first fluid chamber 121*a* and the expansion chamber 303. Likewise, as shown in FIG. 4, the valve 305 may be configured to provide selective fluid communication between the first fluid chamber 409*a* and the expansion chamber 303. A pressure measuring device, such as the illustrated gauge "G", is configured to monitor the pressure of the first fluid chamber 121*a*, 409*a* when the apparatus 301, 401 is placed in the first condition. The pressure measuring device is also configured to monitor the equalized pressure of the first fluid chamber 121*a*, 409*a* and the expansion chamber 303 when the apparatus 301, 401 is placed in the second condition.

As further illustrated, the apparatus 301, 401 may also include a pressure source "P" configured to provide the pressure of the first fluid chamber 121*a*, 409*a* in the first condition. In one example, the apparatus 301, 401 includes a valve 307 configured to provide selective fluid communication between the first fluid chamber 121*a*, 409*a* and the pressure source "P". The valves 305, 307 may be provided as separate valves although, as shown, the valves 305, 307 may be incorporated as a three-way valve 309.

In further examples, the apparatus 301, 401 may be provided with a vacuum source 311 configured to selectively apply a vacuum to the expansion chamber 303. The vacuum source may comprise a pump or other device configured to evacuate the expansion chamber 303.

Methods of operating an apparatus 101, 301, 401 will now be described wherein the apparatus 101, 301, 401 includes the previously discussed body 103, 404 with the cavity 105, 407 and the piston 119, 405 dividing the cavity into a first fluid chamber 121*a*, 409*a* and a second fluid chamber 121*b*, 409*b*. As discussed more fully below, the method includes the step (I) of applying fluid pressure to at least one of the first fluid chamber 121*a*, 409*a* and the second fluid chamber 121*b*, 409*b*. As further discussed below, the method further includes the step (II) of determining a position of the piston 119, 405 within the cavity 105, 407 based on the applied fluid pressure.

For example, with reference to the example apparatus 101 of FIGS. 1 and 2, as discussed above, the piston 119 is movable within the cavity 105 between the first position (shown in FIG. 1) and the second position (shown in FIG. 2). As shown in FIG. 1, the pressure port 107 is configured to be placed in fluid communication with the first fluid chamber 121*a* in the first position and the second fluid chamber 121*b* in the second position. The method can include the step (II) of determining the position of the piston 119 within the cavity 105 based on the applied fluid pressure. Step (II) can include monitoring a pressure of the pressure port 107 to determine the position of the piston within the cavity.

For example, step (I) can include pressurizing the first fluid chamber 121*a* with the applied fluid pressure to bias the piston towards the first position. For instance, the pressure source "P1" may apply fluid pressure to the first fluid chamber 121*a*. Step (II) can include comparing the monitored pressure with the applied pressure to determine whether the piston is located in the first position. For instance, a reading can be taken from the pressure measuring device, such as the gauge "G". If the pressure reading matches the applied pressure to the first fluid chamber 121*a*, then it can be confirmed that the piston 119 is located in the first position. Another reading of the gauge "G" may indicate that the piston is located in the second position by indicating a pressure associated with the second fluid chamber 121*b*, or the gauge "G" may provide a reading that indicates that the piston is located in an intermediate position wherein the piston blocks communication of the pressure port 107 with the first or second fluid chamber 121*a*, 121*b*.

In another example, step (I) can include pressurizing the second fluid chamber 121*b* with the applied fluid pressure to bias the piston towards the second position. For instance, the pressure source "P2" may apply fluid pressure to the second fluid chamber 121*b*. Step (II) can include comparing the monitored pressure with the applied pressure to determine whether the piston is located in the second position. For instance, a reading can be taken from the pressure measuring device, such as the gauge "G". If the pressure reading matches the applied pressure to the second fluid chamber 121*b*, then it can be confirmed that the piston 119 is located in the second position. Another reading of the gauge "G" may indicate that the piston is located in the first position by indicating a pressure associated with the first fluid chamber 121*a*, or the gauge "G" may provide a reading that indicates that the piston is located in an intermediate position wherein the piston blocks communication of the pressure port 107 with the first or second fluid chamber 121*a*, 121*b*.

As described above, the pressure source "P1" may be designed to bias the piston towards the first position while the pressure source "P2" may be designed to bias the piston towards the second position. For example, under normal operating conditions, the pressure source "P1" may move the piston 119 to the first position. In further examples, the pressure source "P2" may move the piston 119 to the second position. In such an example, the pressure sources "P1", "P2" may optionally facilitate actuation of the force transmission rod 123 to apply a force in direction 127 or an opposite direction. In further examples, a pressure may be applied during step (I) that does not result in movement of the piston in the cavity. In such an example, the applied pressure is not significant enough to cause movement of the piston 119.

The apparatus 301 of FIG. 3 can be used wherein step (I) pressurizes at least one of the first fluid chamber 121*a* and the second fluid chamber 121*b*. For example, while the valve 307 is open and the valve 305 is closed, the pressure source "P" may be used to pressurize the first fluid chamber 121*a*. Although not shown, in an alternative example, the apparatus 301 may be reconfigured such that the pressure source "P" is designed to pressurize the second fluid chamber 121*b*. The method step (II) further includes measuring a volume of a fluid chamber pressurized during step (I). For example, the configuration shown in FIG. 3 is designed to measure the volume of the first fluid chamber 121*a* that is pressurized with the pressure source "P".

The apparatus 401 of FIG. 4 can be used wherein step (I) pressurizes at least one of the first fluid chamber 409*a* and the second fluid chamber 409*b*. For example, while the valve 307 is open and the valve 305 is closed, the pressure source "P" may be used to pressurize the first fluid chamber 409*a*. Although not shown, in an alternative example, the apparatus 401 may be reconfigured such that the pressure source "P" is designed to pressurize the second fluid chamber 409*b*. The method step (II) further includes measuring a volume of a fluid chamber pressurized during step (I). For example, the configuration shown in FIG. 4 is designed to measure the volume of the first fluid chamber 409*a* that is pressurized with the pressure source "P".

The step of measuring the volume of the pressurized fluid chamber can include calculating a volume of the pressurized fluid chamber. In some examples, the calculated volume of the pressurized fluid chamber may be used to determine the position of the piston in the cavity. For example, the overall cavity 105, 407 includes a known volume. So once the volume of the pressurized fluid chamber is calculated, the position of the piston is determined, for example, by comparing the calculated volume of the pressurized fluid chamber with the known total volume of the overall cavity 105, 407.

The step of calculating can comprise calculating at a desired time, intermittent calculating at predetermined times, continuously calculating or other calculating methods. For example, the step of calculating can comprise continuously calculating the volume of the pressurized fluid chamber to continuously determine the position of the piston in the cavity.

On example of calculating the volume of the pressurized fluid chamber 121*a*, 409*a* includes the step of measuring an initial pressure of the pressurized fluid chamber 121*a*, 409*a*. For example, a pressure measuring device, such as the illustrated pressure gauge "G", can be used to measure the initial pressure "Pi" of the pressurized fluid chamber 121*a*, 409*a*. The method can further include the step of evacuating the expansion chamber 303 such that the expansion chamber 303 includes an initial volume "Vi" after evacuating the expansion chamber 303. During evacuation, the valve 305 may be closed and an evacuation valve 313 may be open such that a vacuum source 311 may evacuate the expansion chamber 303. The method of calculating then includes the step of placing the expansion chamber 303 in fluid communication with the pressurized fluid chamber 121*a*, 409*a* such that gas expands from the pressurized fluid chamber 121*a*, 409*a* to the expansion chamber to at least partially depressurize the pressurized fluid chamber. Once the pressurized fluid chamber is at least partially depressurized, the previous pressurized fluid chamber can be considered a depressurized fluid chamber. Depressurization can be carried out, for example, by closing the evacuation valve 313 and opening the valve 305 to permit fluid communication between the expansion chamber 303 and the pressurized fluid chamber 121*a*, 409*a*. Understandably, fluid will consequently flow from the pressurized fluid chamber 121*a*, 409*a* and into the expansion chamber 303 until equilibrium is achieved wherein an equalized pressure "Pe" is obtained in the depressurized fluid chamber 121*a*, 409*a* and the expansion chamber 303 while the expansion chamber 303 includes a final volume "Vf". The equalized pressure "Pe" can then be measured, for example with the pressure measuring device, such as the gauge "G." The method further includes the step of calculating the volume "Vc" of the depressurized fluid chamber 121*a*, 409*a* based on the initial pressure "Pi" of the pressurized fluid chamber 121*a*, 409*a*, the final volume "Vf" of the expansion chamber 303, and the equalized pressure "Pe" with the equation:

$$Vc = \frac{Vf}{\left(\frac{Pi}{Pe} - 1\right)}$$

In some examples, the calculated volume of the pressurized fluid chamber may be used to determine the position of the piston in the cavity. For example, the overall cavity 105, 407 includes a known volume. So once the volume "Vc" of the depressurized fluid chamber is calculated, the position of the piston is determined, for example, by comparing the determined volume "Vc" of the depressurized fluid chamber with the known total volume of the overall cavity 105, 407.

In some examples, the expansion chamber 303 has a fixed volume such that the initial volume "Vi" is equal to the final volume "Vf" of the expansion chamber 303. In further examples, the expansion chamber may have a variable volume. In such examples, evacuation of the chamber may result in "Vi" being substantially equal to zero. Vf can then be measured by a reading off the expansion chamber. For example, the expansion chamber may include a plunger that is pulled down to evacuate the expansion chamber and then the plunger will rise to the final volume "Vf" that may be measured by how far the plunger rises in the chamber.

As with the apparatus 101 of FIGS. 1 and 2, in some examples of the method corresponding to FIGS. 3 and 4, a pressure may be applied during step (I) that does not result in movement of the piston in the cavity. In such an example, the applied pressure is not significant enough to cause movement of the piston 119. In particular, the apparatus 401 includes a piston 405 that has a relatively small surface area when compared to the piston 119. As such, the relatively small force from pressurizing the fluid chamber 409*a* may be designed to have little or no effect on the movement of the primary piston 119. Moreover due to the link 413 the position of the piston 405 in the cavity 407 is indicative of the position of the piston 119 in the cavity 105. As such, determining the position of the piston 405 can consequently result in determining the position of the piston 119.

It will be apparent to those skilled in the art that various modifications and variations can be made without departing from the spirit and scope of the claimed invention.

What is claimed is:

1. An apparatus comprising:

a body comprising a cavity and a single pressure port extending through a wall of the body and fluidly communicating with the cavity; and a piston dividing the cavity into a first fluid chamber and a second fluid chamber, wherein the piston is movable within the cavity between a first position wherein the single pressure port is in fluid communication with the first fluid chamber and a second position wherein the single pressure port is in fluid communication with the second fluid chamber; wherein the piston longitudinally passes the single port when moving between the first position and the second position to allow the single port to measure the pressure of one of the first fluid chamber and the second fluid chamber at the first position, and the other of the first fluid chamber and the second fluid chamber at the second position.

2. The apparatus of claim 1, further comprising a pressure measuring device connected to the single pressure port for measuring a fluid pressure of the pressure port.

3. The apparatus of claim 1, further comprising a pressure source configured to pressurize at least one of the first fluid chamber and the second fluid chamber.

4. A method of operating an apparatus comprising a body with a cavity and a piston dividing the cavity into a first fluid chamber and a second fluid chamber, wherein the piston is movable within the cavity, the method comprising the steps of:

(I) applying fluid pressure to at least one of the first fluid chamber and the second fluid chamber; and (II) determining a position of the piston within the cavity based on the applied fluid pressure by:

measuring an initial pressure of the pressurized fluid chamber;

evacuating an expansion chamber of the apparatus, wherein the expansion chamber has an initial volume; then placing the expansion chamber in fluid communication with the pressurized fluid chamber such that fluid expands from the pressurized fluid chamber to the expansion chamber to at least partially depressurize the pressurized fluid chamber, wherein an equalized pressure is obtained in the depressurized fluid chamber and the expansion chamber and wherein the expansion chamber has a final volume; then measuring the equalized pressure; and then calculating the volume of the depressurized fluid chamber based on the initial pressure, the final volume, and the equalized pressure.

5. The method of claim 4, wherein the piston is movable within the cavity between a first position and a second position and the apparatus further includes a single pressure port that extends through a wall of the body and is positioned to be placed in fluid communication with the first fluid chamber in the first position and the second fluid chamber in the second position, and wherein step (II) includes monitoring a pressure of the single pressure port to determine the position of the piston within the cavity.

6. The method of claim 5, wherein step (I) includes pressurizing the first fluid chamber with the applied fluid pressure to bias the piston towards the first position and step (II) includes comparing the monitored pressure with the applied pressure to determine whether the piston is located in the first position.

7. The method of claim 5, wherein step (I) includes pressurizing the second fluid chamber with the applied fluid pressure to bias the piston towards the second position and step (II) includes comparing the monitored pressure with the applied pressure to determine whether the piston is located in the second position.

8. The method of claim 5, wherein step (I) does not result in movement of the piston in the cavity.

9. The method of claim 4, wherein step (I) pressurizes at least one of the first fluid chamber and the second fluid chamber and step (II) includes measuring a volume of a fluid chamber pressurized during step (I).

10. The method of claim 9, wherein the step of measuring a volume of the pressurized fluid chamber includes calculating a volume of the pressurized fluid chamber.

11. The method of claim 10, wherein the calculated volume of the pressurized fluid chamber is used to determine the position of the piston in the cavity.

12. The method of claim 10, wherein the step of calculating comprises continuously calculating the volume of the pressurized fluid chamber to continuously determine the position of the piston in the cavity.

13. The method of claim 4, wherein the determined volume of the chamber together with a known volume of the cavity is used to determine the position of the piston in the cavity.

14. The method of claim 4, wherein step (I) does not result in movement of the piston in the cavity.

15. The method of claim 4, wherein the expansion chamber has a fixed volume such that the initial volume is equal to the final volume.

* * * * *